US009822436B2

(12) United States Patent
Peruzzi et al.

(10) Patent No.: US 9,822,436 B2
(45) Date of Patent: Nov. 21, 2017

(54) METHOD FOR THE PRODUCTION AND REMOVAL OF A TEMPORARY PROTECTIVE LAYER FOR A CATHODIC COATING

(75) Inventors: Martin Peruzzi, Linz (AT); Josef Faderl, Steyr (AT); Siegfried Kolnberger, Pasching (AT); Werner Brandstatter, Linz (AT)

(73) Assignee: voestalpine Stahl GmbH, Linz (AT)

( * ) Notice: Subject to any disclaimer, the term of this patent is extended or adjusted under 35 U.S.C. 154(b) by 2505 days.

(21) Appl. No.: 12/599,677

(22) PCT Filed: Jan. 30, 2008

(86) PCT No.: PCT/EP2008/000721

§ 371 (c)(1),
(2), (4) Date: Mar. 7, 2011

(87) PCT Pub. No.: WO2008/138412

PCT Pub. Date: Nov. 20, 2008

(65) Prior Publication Data

US 2011/0139308 A1 Jun. 16, 2011

(30) Foreign Application Priority Data

May 11, 2007 (DE) ..... 10 2007 022 174

(51) Int. Cl.
*C23C 8/10* (2006.01)
*C23C 22/62* (2006.01)
(Continued)

(52) U.S. Cl.
CPC ..... *C23C 2/02* (2013.01); *B24C 1/086* (2013.01); *C21D 1/68* (2013.01); *C21D 8/0484* (2013.01);
(Continued)

(58) Field of Classification Search
CPC .. C23C 8/10; C23C 22/62; C21D 1/68; C21D 8/0484; B24C 1/086
See application file for complete search history.

(56) References Cited

U.S. PATENT DOCUMENTS

2007/0256808 A1* 11/2007 Fleischanderl et al. ..... 164/72

FOREIGN PATENT DOCUMENTS

DE 19942785 A1 3/2001
DE 10243035 B4 1/2006
(Continued)

*Primary Examiner* — Lois Zheng

(57) ABSTRACT

The invention relates to a method for the production and removal of a temporary protective layer for a cathodic coating, particularly for the production of a hardened steel component with an easily paintable surface, wherein a steel sheet made of a hardenable steel alloy is subjected to a preoxidation, wherein said preoxidation forms a FeO layer with a thickness of 100 nm to 1,000 nm and subsequently a melt dip coating is conducted, wherein, during the melt dip coating, a zinc layer is applied having a thickness of 5 to 20 μm, preferably 7 to 14 μm, on each side, wherein the melt dip process and the aluminum content of the zinc bath is adjusted such that, during the melt dip coating, an aluminum content for the barrier layer results of 0.15 g/m$^2$ to 0.8 g/m$^2$ and the steel sheet or sheet components made therefrom is subsequently heated to a temperature above the austenitizing temperature and is then cooled at a speed greater than the critical hardening speed in order to cause hardening, wherein oxygen-affine elements are contained in the zinc bath for the melt dip coating in a concentration of 0.10 wt.-% to 15 wt.-% that, during the austenitizing on the surface of the cathodic protective layer, form a thin skin comprised of the oxide of the oxygen-affine elements and said oxide layer is blasted after hardening by irradiation of the sheet component with dry ice particles.

3 Claims, 4 Drawing Sheets

(51) Int. Cl.

| | |
|---|---|
| ***C23C 2/02*** | (2006.01) |
| ***B24C 1/08*** | (2006.01) |
| ***C21D 1/68*** | (2006.01) |
| ***C21D 8/04*** | (2006.01) |
| ***C23C 2/06*** | (2006.01) |
| ***C23C 2/26*** | (2006.01) |
| ***C23C 2/28*** | (2006.01) |
| *C23C 2/14* | (2006.01) |

(52) U.S. Cl.
CPC ..... *C23C 2/06* (2013.01); *C23C 2/26* (2013.01); *C23C 2/28* (2013.01)

(56) References Cited

FOREIGN PATENT DOCUMENTS

| | | | | | |
|---|---|---|---|---|---|
| EP | 1034890 | A2 | | 9/2000 | |
| EP | 1321625 | B1 | | 9/2004 | |
| EP | 1561542 | A1 | | 8/2005 | |
| JP | 06-269839 | | * | 9/1994 | ..... B21B 45/04 |
| JP | 10140311 | A | | 5/1998 | |
| SU | 1240412 | | * | 6/1986 | ..... A47L 5/14 |
| WO | 2005021820 | A1 | | 3/2005 | |
| WO | 2005021822 | A1 | | 3/2005 | |

* cited by examiner

METHOD FOR THE PRODUCTION AND REMOVAL OF A TEMPORARY PROTECTIVE LAYER FOR A CATHODIC COATING

FIELD OF THE INVENTION

The invention relates to a method for producing and removing a temporary protective layer for a cathodic coating on supporting metals.

BACKGROUND OF THE INVENTION

EP 1 561 542 A1 has disclosed a method for removing a layer of a component. It involves a layer composed of an organic binding agent, which is to be removed from a substrate without damaging the substrate. To this end, a blasting jet of dry ice particles is guided over the surface so that the action of the dry ice particles removes material from the layer containing an organic binding agent. The dry ice removal is intended to avoid a contamination with foreign substances and to not harm the metallic base body of the component.

EP 1 321 625 B1 has disclosed a method for removing a metal layer in which a layer system includes the metal layer and a substrate coated by the metal layer and in which the removal process is a blasting process. The blasting process here can be a sand blasting process in which the metal layer is powerfully cooled in order to achieve a low-temperature embrittlement of the coating in relation to the substrate.

EP 1 034 890 A2 has disclosed a method and device for blasting with different blasting media. Its intent is to achieve an abrasive blast treatment with blasting media in which the abrasive action of the blasting media lies between that of blasting media that are in fluid form under normal conditions and that of blasting media that are in a solid aggregate state under normal conditions. In this case, a mixture of a first blasting medium such as dry ice and a second abrasive blasting medium such as sand is used.

DE 199 46 975 C1 has disclosed a device and method for removing a coating from a substrate, which is intended to be gentle to the material and suitable for removing both soft and hard coatings. According to this method, a cold treatment is carried out by blasting with a coolant, which results in an embrittlement of the coating, and then an abrasive cleaning action is carried out with a machining tool; because of the cold treatment, the mechanically abrasive machining can be carried out with tool parts that are not as hard as machining tools according to the prior art.

DE 199 42 785 A1 has disclosed a method for removing solid machining residues, surface coatings, or oxide layers; the intent is for a cleaning to take place only in locations where solid machining residues are present. The cleaning in this case can be carried out with steam jets, dry ice jets, or by cleaning with technically induced shock waves, so-called laser cleaners. The $CO_2$ cleaning can be carried out using intrinsically known dry ice pellets.

DE 102 43 035 B4 has disclosed a method and device for removing layers that form on metal components due to heating and cooling. When removing for example cinders, oxide silicate, and slag coatings on metal work pieces and in particular, metal work pieces with uneven surfaces such as axle components and autobody components for motor vehicles, since the solid particles in abrasive compressed gas jets do not completely remove the layers from metal work pieces in all cases, the flow of compressed gas used to project e.g. dry ice particles at the metal work piece to be cleaned should be preheated and should have a temperature that is greater than the temperature of the air surrounding the metal work piece and/or the surface temperature of the metal work piece. This should assure on the one hand, that the metal work piece is not cooled too intensely and on the other hand, that the compressed gas is at least essentially free of moisture so as to avoid an undesirable formation of condensation. The layers to be removed from the surface of the metal piece are removed by means of the mechanical action of the dry ice particles, which strike it at a high velocity and therefore have an abrasive action, and by means of the dry ice particle-induced, localized cooling of the surface and coating.

WO 2005/021822 of the applicant has disclosed a method for protecting a cathodic anticorrosion layer by adding—within certain limits—oxygen-affinity elements to the metal composing the cathodic protective layer in order to protect the cathodic protective layer during the hardening of a component manufactured from the cathodically protected metal. To harden components of this kind, they must be heated to a temperature above the austenitizing temperature of the base metal, in this case steel. Particularly with high-hardening steels, this temperature is above 800° C. At such temperatures, most cathodic protective layers are destroyed by evaporation or oxidation so that a component treated in this way would not have any cathodic protection after hardening. Because oxygen-affinity elements have been added, the oxygen-affinity elements diffuse out of the compound composing the cathodic protective layer and migrate to the surface, forming a very fine protective layer there. This very fine protective layer can, for example, be composed of magnesium oxide, aluminum oxide, or mixtures thereof. WO 2005/021820 has also disclosed using a method of this kind in roll profiling.

The object of the present invention is to create a method with which it is possible to improve paint adhesion to hardened steel components provided with a cathodic protective layer.

SUMMARY OF THE INVENTION

The invention is based on the recognition that under certain conditions, the paint adhesion can be less than optimal in cathodic protective layers provided with a fine surface-protecting coating. On the other hand, there is no alternative to the formation of these thin layers since otherwise, the only possible option would be to carry out a secondary galvanizing of these components, which is very complex and expensive.

The invention is also based on the discovery that under certain circumstances, such a protective layer for a cathodic protective layer inherently complicates a phosphating pretreatment for the painting process.

According to the invention, therefore, the fine protective layer is composed of one or more oxygen-affinity elements so that it can be removed again, i.e. is present only temporarily, in order to assure a protection of the cathodic layer during the heating to a temperature above the austenitizing temperature, i.e. annealing process.

According to the invention, this thin protective layer is composed of at least one oxide of the oxygen-affinity elements so that cracks and/or defects form in this layer. These cracks permit the flakes delimited by these cracks and/or defects to be loosened from the oxide by means of dry ice blasting.

With the latest cathodic protective coatings, which have a protective layer of oxides of oxygen-affinity elements, however, the conventional sandblasting fails or can only be used to a limited degree since the conventional cleaning processes of the abrasive type would remove a majority of the cathodic layer. In addition, sandblasting also has a negative impact on the dimensional consistency of the components and also requires a secondary cleaning.

According to the invention, the blasting is carried out only with dry ice, without additives; the dry ice particles penetrate through the cracks and/or defects into the cavities beneath the protective layer and sublimate, increasing in volume by up to 800 times. As a result, the possibly loose particles or particles to be loosened are blasted off from the oxide of the oxygen-affinity element(s), along with zinc oxide particles that may be present. The additional thermal shock due to the supercooled dry ice particles results in additional thermal stresses in the layer composed of the oxide of the oxygen-affinity element(s) and consequently promotes the removal of undesirable materials. An abrasive removal should and must be avoided, though, since it attacks the cathodic protective layer.

This does not influence or remove the zinc or zinc-iron layer that is both desirable and required for the cathodic corrosion protection. With the method according to the invention, it is thus possible to achieve a selective removal of the poorly adhering oxides. Oxides with good adhesion to the surface, however, remain on the surface and also have no negative influence on the paintability.

According to the invention, it has turned out that producing the cracks in the layer requires process steps that must be carried out on the component itself, long before the production of the cathodic layer. While the cavities always form under the fine protective layer, which is due to the ongoing iron-zinc reaction in the cathodic anticorrosion layer during annealing in the radiation furnace, the present invention has led to the discovery that the thickness and cracking of the fine protective layer composed of the oxide of the oxygen-affinity element(s) depend on the pretreatment of the blank steel band and its influence on the interface boundary kinetics and development between the zinc and the steel substrate during the hot-dip coating and on the zinc surface.

"Pretreatment" is understood here to mean a preoxidation of the blank steel band as described in DE 100 59 566 B3 and in EU Search Report No. 7210-PA/118. This type of pretreatment is conventionally used to optimize the properties of high-strength steels. This improves the adhesion properties of the zinc coating in the hot-dip coating process, particularly with steel bands containing high levels of alloy constituents.

As a result, the inhibiting layer formation can affect the thickness and cracking of the fine protective layer. An "inhibiting layer" refers to a layer that, due to an addition of aluminum to the zinc bath, forms between the steel substrate and the zinc layer during the continuous hot-dip coating process and the possibly subsequent heat treatment. The purpose of the inhibiting layer in general is to slow an excessively powerful alloying or reaction between iron and zinc.

If this inhibiting layer is too thick, the reaction of zinc with iron during the heating to a temperature above the austenitizing temperature occurs in a decelerated fashion, as a result of which the iron-zinc phases being produced cause little or no damage to the superposed, slowly accreting layer of the oxide of the oxygen-affinity element(s). Consequently, the thickness of the fine protective layer increases only slowly and also, no intense cracking occurs since the now rather thin $Al_2O_3$ layer lies like a thin skin over the iron-zinc phases. The same effect occurs if too thick a zinc deposit is selected.

The invention will be explained by way of example in conjunction with the drawings.

DETAILED DESCRIPTION OF THE PREFERRED EMBODIMENTS

Figure 1:
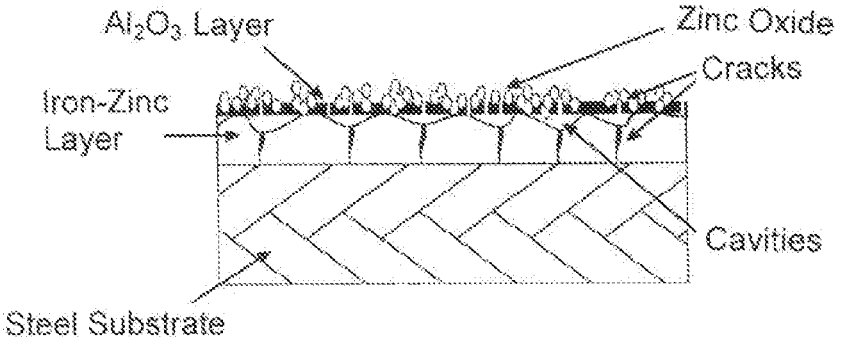
FIG. 1 shows a layer structure according to the invention, which responds well to being processed using a method according to the invention.

The surface shown in FIG. 1, in which cracks and/or defects occur in the $Al_2O_3$ layer due to the heat treatment and hardening, is ideal for being cleaned with dry ice. The dry ice particles penetrate through the depicted cracks into the cavities beneath the $Al_2O_3$ layer and sublimate there as explained above. In this case, the dry ice cleaning is carried out in such a way that the dry ice particles do not attack the iron-zinc layer underlying the $Al_2O_3$ layer and also do not blast away the particles that adhere to the iron-zinc layer so firmly that they represent no problem for the paintability. As is evident in FIG. 1, the necessary requirements are met, namely that cavities must be present beneath the $Al_2O_3$ layer, the $Al_2O_3$ layer must have a certain thickness, and in addition, cracks must be present. Molten zinc can also vaporize through the cracks; it reacts with the oxygen in the air to form zinc oxide and recondenses on the protective $Al_2O_3$ layer. By contrast with this, in FIG. 2, not only does the iron-zinc layer undulate less, but also the $Al_2O_3$ layer has larger enclosed regions that extend beyond the cavities produced by the undulations in the iron-zinc layer. In addition, a correspondingly small amount of zinc oxide forms in the region of the cracks. Since parts of the cavities are covered by the $Al_2O_3$ layer, it is not possible to produce a blasting action through sublimation in the cavities.

Figure 2:
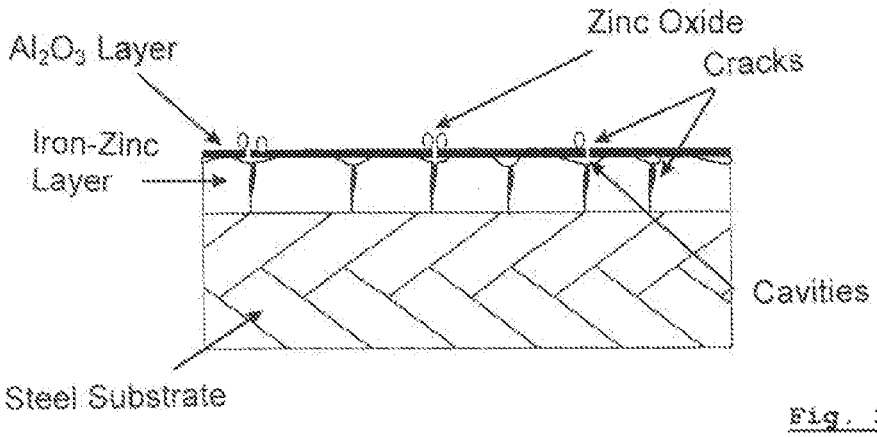
FIG. 2 shows a comparative depiction of a surface that cannot be cleaned well.
Figure 3:
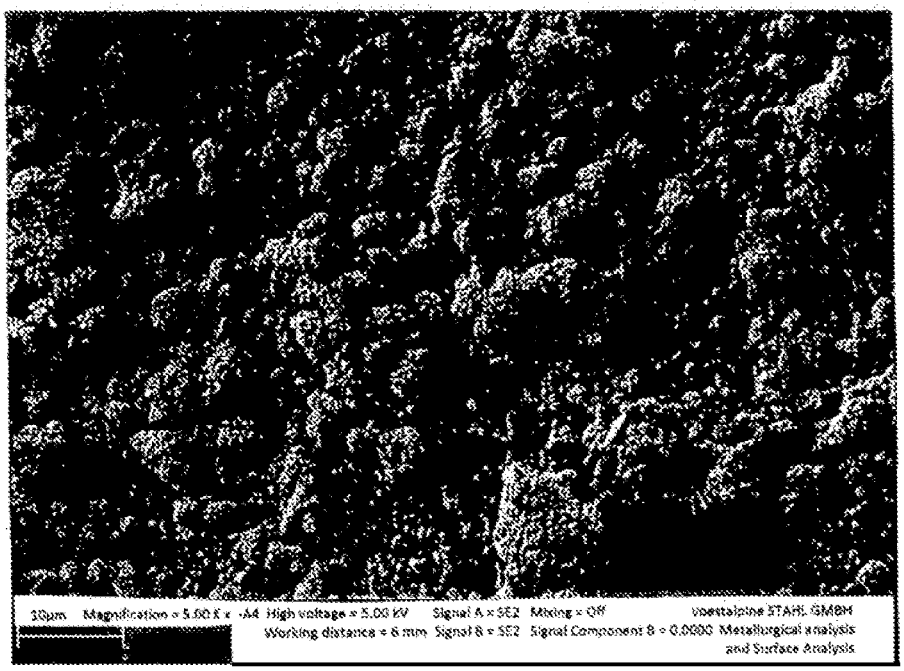
FIG. 3 shows a surface that can be cleaned well according to FIG. 1, in a scanning electron microscope image taken from above.
Figure 4:
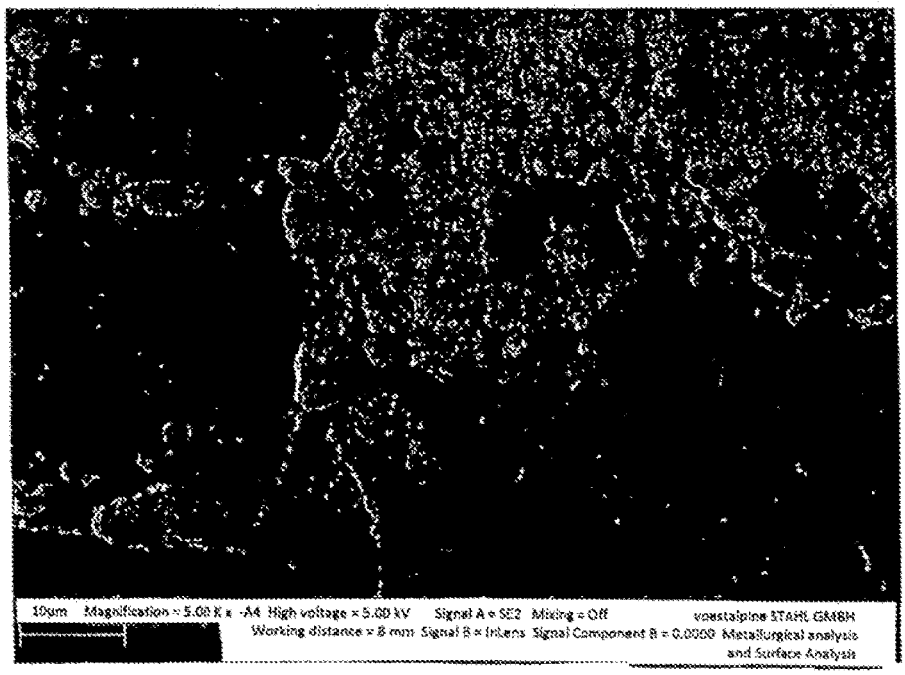
FIG. 4 shows a surface according to FIG. 2 that cannot be cleaned well, in a scanning electron microscope image taken from above.

FIGS. 3 and 4 show electron microscope images, taken from above, of the states schematically depicted in FIGS. 1 and 2. Both cases involve a piece of sheet metal 1.0 mm thick, which has been annealed at 910° C. for 250 seconds in a radiation furnace and has then been hardened between cooled steel plates. FIG. 4 shows the surface after the hardening for the case of a thick inhibiting layer formation and/or an excessively thick zinc deposit. Since the $Al_2O_3$ layer in this case is comparatively thin, the electron beam is more easily able to penetrate it. The cavities situated beneath the $Al_2O_3$ layer are therefore visible as dark areas in the image since in these areas, fewer backscatter electrons from the $Al_2O_3$ layer contribute to the detector signal.

If the aluminum oxide layer is thicker and has more cracks, then the scanning electron microscope image shows a continuous $Al_2O_3$ layer without dark patches. In the case shown in FIG. 3, the $Al_2O_3$ layer is approx. 150 nm to 200 nm thick. The state shown in FIG. 3 is the desired state, while the undesirable state shown in FIG. 4 corresponds to the conditions according to FIG. 2.

Figure 5:
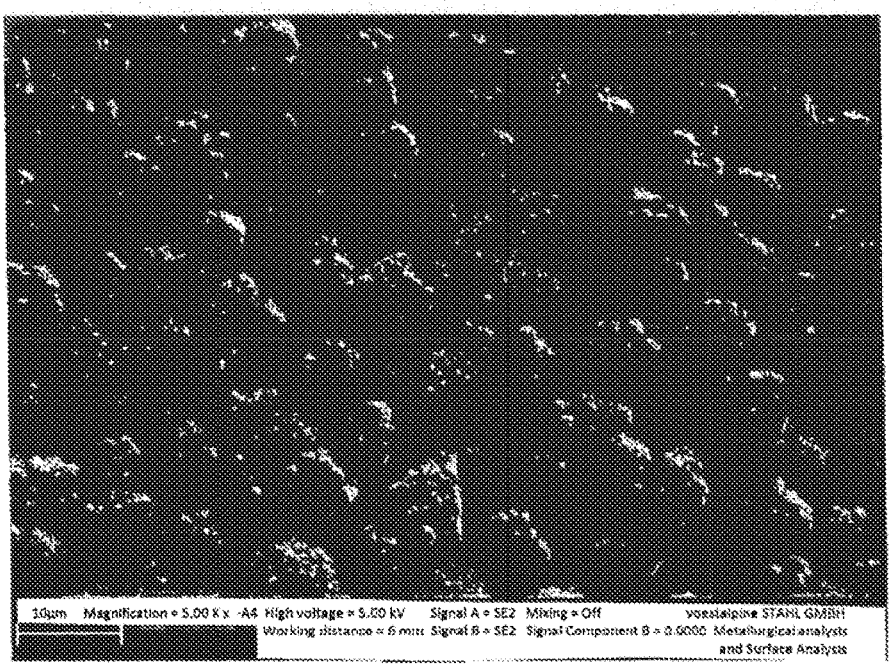
FIG. 5 shows the surface of the sample according to FIG. 3 after the cleaning step according to the invention.

FIG. 5 shows a surface according to FIG. 3, which has undergone the cleaning process according to the invention. The iron-zinc phases are clearly visible. An extensive $Al_2O_3$ and zinc oxide coverage is no longer visible. This surface produced according to the invention is very suitable for phosphating or some other form of aftertreatment and also demonstrates a very good paint adhesion.

Figure 6:
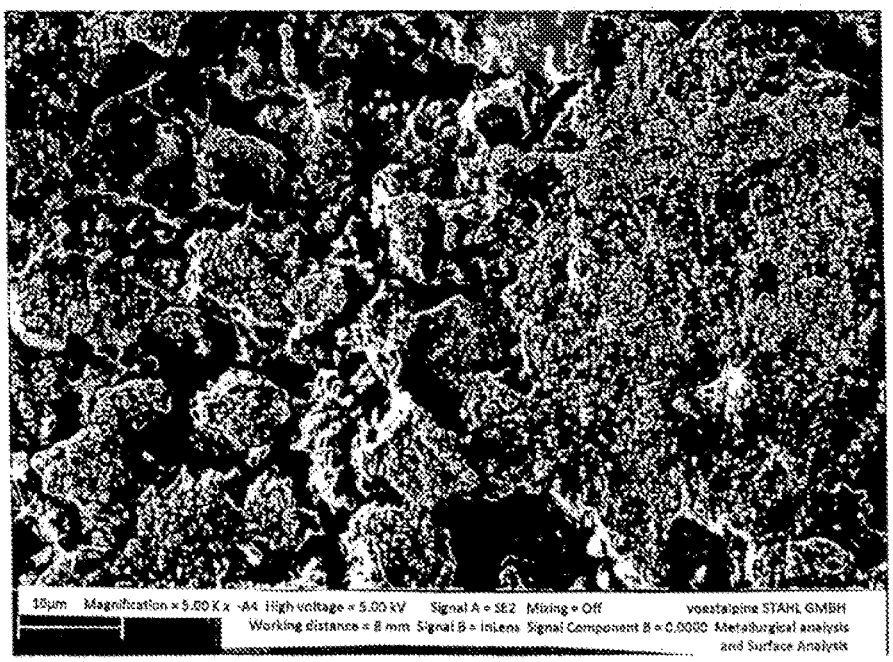
FIG. 6 shows a surface according to FIG. 4 after a cleaning process is carried out.

FIG. 6 shows the surface according to FIG. 4, after the execution of the dry ice cleaning method. The darker areas show non-removed $Al_2O_3$ and a surface that only permits a low level of paintability.

Figure 7:
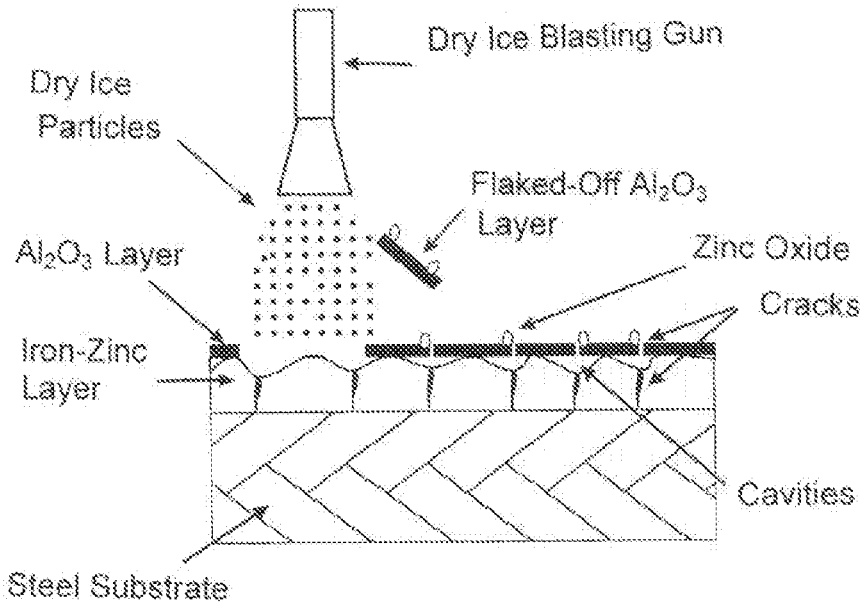
FIG. 7 schematically depicts the cleaning process according to the invention.

The method according to the invention is shown in FIG. 7; by means of a dry ice blasting gun, dry ice particles are shot at the $Al_2O_3$ layer, travel into the cavities, and sublimate therein. The enormous volume expansion that occurs upon sublimation detaches $Al_2O_3$ flakes along with zinc oxide residues adhering to them so that the iron-zinc layer, with its surface finish (see FIG. 5), remains behind.

According to the invention, the pretreatment and hot-dip coating process are carried out so that during the preoxidation, a FeO layer of greater than 100 nm but less than 1,000 nm forms, and preferably an inhibiting layer forms, which has an aluminum content of 0.15 g/m$^2$ to 0.4 g/m$^2$. During the heating to a temperature above the austenitizing temperature in the radiation furnace, an intensified zinc-iron reaction occurs, which results in a breaking-up of the $Al_2O_3$ protective layer. Higher aluminum contents lead to a state of the type described in FIG. 4. Lower aluminum contents lead to an incomplete formation of the inhibiting layer and to a zinc-iron reaction that already takes place during the galvanizing process. This also results in the fact that the zinc can peel off during the cold forming.

Preferably, the zinc layer deposit for carrying out the method according to the invention is between Z100 and Z200, i.e. between 7 μm and 14 μm per side. At higher deposits, the thorough reaction of the zinc-iron phases is delayed all the way to the surface as a result of which the $Al_2O_3$ layer is damaged only slightly and therefore remains thin. At lower deposits the cathodic corrosion protection can be insufficient.

From a purely general standpoint, it can also be mentioned that through the proliferation of cracks and/or defects in the $Al_2O_3$ layer, this layer grows from underneath due to oxygen diffusion. Thicker $Al_2O_3$ layers, moreover, already tend to form cracks due to thermal stresses during the heating to a temperature above the austenitizing temperature. With a thinner $Al_2O_3$ layer, few cracks in the $Al_2O_3$ layer form during the heating to a temperature above the austenitizing temperature and the low level of oxygen diffusion results in only a thin $Al_2O_3$ skin over the zinc-iron mixed phases.

The invention will be explained by means of examples.

EXAMPLE 1

A sheet of 22MnB5 steel 1.0 mm thick is subjected to a preoxidation and a hot-dip coating with approx. 0.2 wt. % aluminum in a zinc bath. The preoxidation is carried out so that a FeO layer thickness of greater than 100 nm but less than 1,000 nm is produced. The galvanizing here is carried out so that a zinc deposit Z200, i.e. 14 μm per side, is achieved. The aluminum content of the inhibiting layer is set to 0.3 g/m$^2$. The sheet is then placed for four minutes in a radiation furnace heated to 910° C., with a normal air atmosphere. As a result, a layer formation according to FIGS. 3 and 5 or according to FIG. 1 occurs. This layer responds favorably to cleaning with dry ice and yields the surface according to FIG. 5 and in subsequent trials, demonstrates the correspondingly favorable paint adhesion.

EXAMPLE 2

A sheet of 22MnB5 steel 1.0 mm thick undergoes a preoxidation and a hot-dip coating process with approx. 0.2 wt. % aluminum in the zinc bath. The preoxidation of the blank sheet is carried out so that a FeO layer thickness of greater than 100 nm and less than 1,000 nm is produced. The galvanizing here is carried out so that a zinc deposit Z200, i.e. 14 μm per side, is achieved. The aluminum content of the inhibiting layer is set to 0.8 g/m$^2$ and annealing conditions correspond to example 1. As a result, an aluminum oxide-rich surface with little zinc oxide is achieved, which only responds poorly to being cleaned with dry ice. As a result, the surface corresponds to FIG. 6 or before the cleaning, to FIG. 4, and in subsequent trials, demonstrates the poor paint adhesion due to extensive $Al_2O_3$ coverage.

EXAMPLE 3

A steel sheet corresponding to examples 1 and 2 is embodied with a zinc deposit of Z300, i.e. 21 μm per side, instead of a zinc deposit of Z200. On the other hand, the preoxidation of the blank steel band is carried out so that a FeO layer thickness of greater than 100 nm and less than 1,000 nm is produced. The aluminum content of the inhibiting layer is set to 0.3 g/m$^2$. The sheet is then placed for four minutes in a radiation furnace heated to 910° C., with a normal air atmosphere. Here, too, the $Al_2O_3$-rich surface not according to the invention forms with little zinc oxide; it responds poorly to being cleaned with dry ice and corresponds to the surface shown in FIG. 4. In subsequent paint trials, a poor paint adhesion is likewise achieved.

The invention has the advantage that a method for producing and removing a temporary protective layer for a cathodic coating is created, which successfully creates a hardened steel component with a cathodic protection; the cathodic protective layer protects the steel—even during the heating—from oxidation and particularly from cinder formation and after a heat treatment and hardening of the steel component, a very highly paintable surface is produced with simple means.

The invention claimed is:

1. A method for producing and removing a temporary protective layer for a cathodic coating, particularly for manufacturing a hardened steel component with a highly paintable surface, comprising:

subjecting a sheet steel. composed of a hardenable steel alloy to a preoxidization process; during the preoxidization process, a FeO layer with a thickness of 100 nm to 1,000 nm forms on the sheet steel;

after the preoxidation process, carrying out a hot-dip coating process; during the hot-dip coating process, a zinc layer with a thickness of 5 to 20 μis deposited on the sheet steel;

setting the hot-dip coating process and an aluminum content in a zinc bath so that during the hot-dip coating process, an aluminum content of 0.15 g/ m$^2$ to0.8 g/m$^2$ is produced in an inhibiting layer and the sheet steel or a component manufactured from the sheet steel is/are heated to a temperature above an austenitizing temperature and then cooled at a speed. that lies above a critical hardening speed, rn order to produce a hardening;

adjusting the zinc bath for the hot-dip coating process to contain oxygen-affinity elements in a quantity of from 0.10 wt. % to 15 wt. % to form a thin skin composed of the oxide of the oxygen-affinity elements on the surface of a cathodic protective layer during the austenitizing and after hardening; and flaking off the oxide layer by blasting the sheet steel or the component with dry ice particles and without abrasive removal of the oxide layer.

2. The method as recited in claim 1, wherein the oxygen-affinity elements in the zinc bath comprise at least one of the group consisting of magnesium, silicon, titanium, calcium, aluminum, manganese, and boron.

3. The method as recited in claim 1, wherein at least one of the oxygen-affinity elements is aluminum and the aluminum forms a thin skin of aluminum oxide.

* * * * *